US005502473A

United States Patent [19]

East et al.

[11] Patent Number: 5,502,473

[45] Date of Patent: Mar. 26, 1996

[54] INK JET HEAD WITH INK CAVITY RESONANCE

[75] Inventors: Amanda H. East; Richard W. Janse Van Rensburg, both of Cambridge, England

[73] Assignee: Videojet Systems Limited, Wood Dale, Ill.

[21] Appl. No.: 688,565

[22] PCT Filed: Dec. 20, 1989

[86] PCT No.: PCT/GB89/01520

§ 371 Date: Aug. 12, 1991

§ 102(e) Date: Aug. 12, 1991

[87] PCT Pub. No.: WO90/06850

PCT Pub. Date: Jun. 28, 1990

[30] Foreign Application Priority Data

Dec. 20, 1988 [GB] United Kingdom ..... 8829625

[51] Int. Cl.[6] ..... B41J 2/025

[52] U.S. Cl. ..... 347/73; 347/75

[58] Field of Search ..... 347/73, 74, 75

[56] References Cited

U.S. PATENT DOCUMENTS 3,577,198 5/1971 Beam ..... 347/74

FOREIGN PATENT DOCUMENTS 0283226 9/1988 European Pat. Off. .

2252740 6/1975 France .

*Primary Examiner*—Joan H. Pendegrass

*Attorney, Agent, or Firm*—Kokjer, Kircher, Bowman & Johnson

[57] ABSTRACT

A modulating device for breaking ink jets in an ink jet printing machine into trains of uniform droplets comprises a nozzle plate 24 provided with a substantially linear array of nozzles and forming one wall of an ink cavity 23; and acoustic generator in the form of an elongate body 26 projecting towards the nozzle plate to transmit acoustic vibrations into ink into the cavity. The body is shaped and tuned to vibrate substantially only in the longitudinal mode and at a resonant frequency which is within ten percent of a frequency to excite natural resonant vibrations in the ink in the cavity between the end of the body and the nozzle plate, the width of the body being less than the length of the nozzle array or of that part of the array associated with that body.

6 Claims, 2 Drawing Sheets

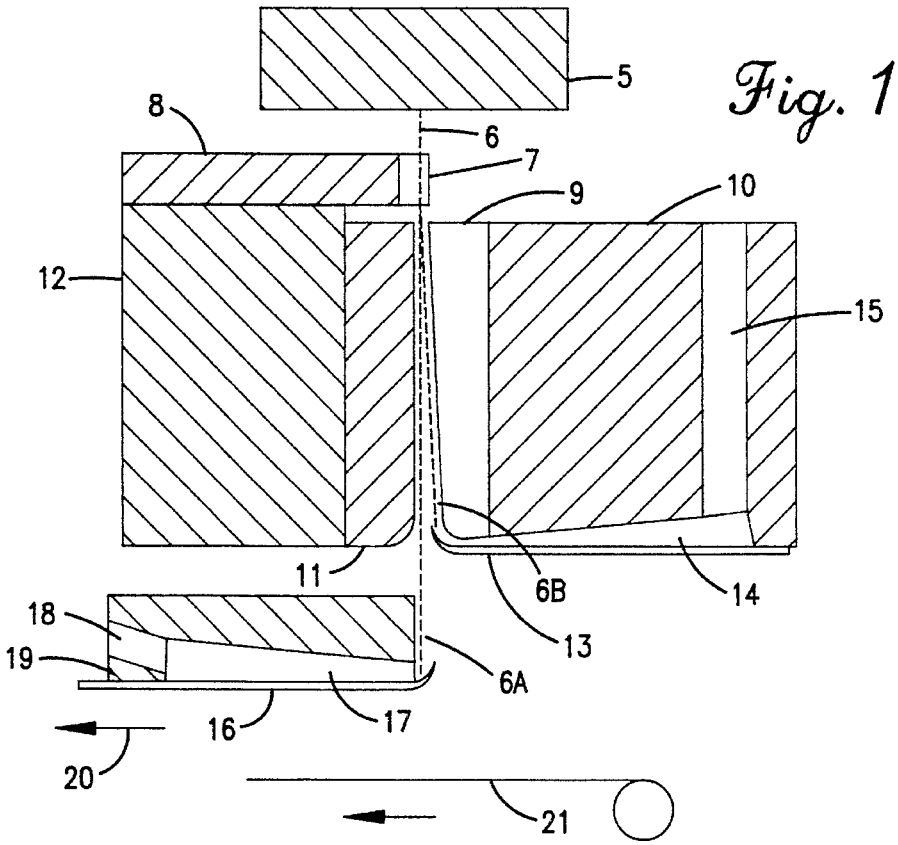
Fig. 1.
Fig. 4.
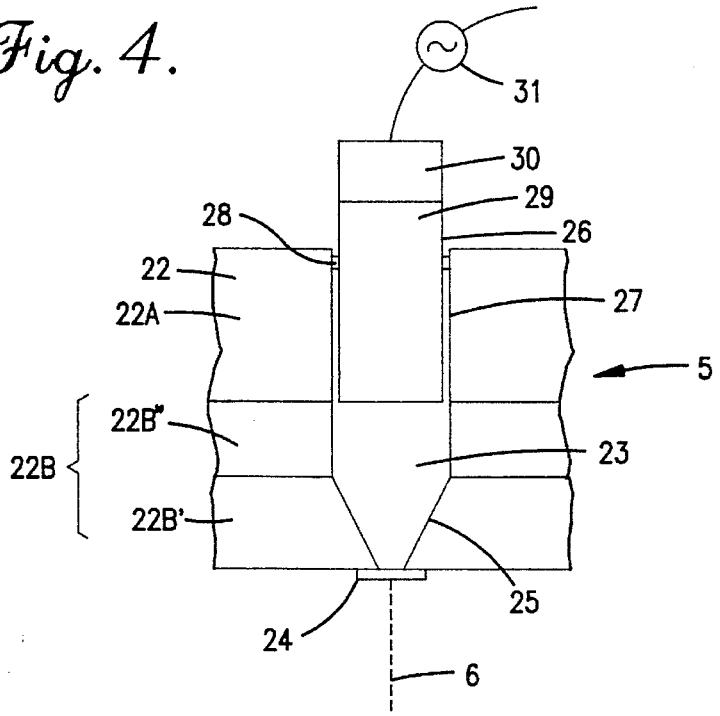

INK JET HEAD WITH INK CAVITY RESONANCE

BACKGROUND OF THE INVENTION

During the operation of continuous ink jet printers it is well known to stimulate or modulate the jet or jets so that they are perturbed and break up into uniformly sized and evenly spaced droplets. To achieve acurate droplet charging, it is important that the droplet stream is satelite free and that the break up point is both stable and occurs within the charge electrode. In a multi jet system there is a further requirement that each jet has near identical break up characteristics, i.e. the break up length, the break up phase and the break up shape are similar from jet to jet.

The necessary jet modulation is, in one conventional technique, achieved by using an acoustic generator to transmit an acoustic wave into a body of ink in an ink cavity one side of which is closed by a nozzle plate through which the or each jet is discharged. The acoustic generator usually consists of or includes a piezoelectric actuator.

With single jet systems, the acoustic generator is usually positioned at the side of the ink cavity opposite to the nozzle plate and sufficient energy is provided to force vibrations of the ink in the direction parallel to the jet, that is perpendicular to the nozzle plate, to cause the jet to break up into droplets. No attempt is made to control vibrations in a direction perpendicular to the jet, as these have no signicant effect upon the operation of the system. In multi-jet systems, (as disclosed for example in GB-A-1464370) the ink cavity may be divided into separate compartments each associated with one acoustic generator and one nozzle, and this is effectively an array of single jet systems.

In other multi jet systems a single acoustic generator is provided for a substantially linear array of nozzles and in this case it has been recognised that it is necessary to stimulate in the ink cavity substantially only "longitudinal" vibrations, parallel to the jets, substantially without any "transverse" vibrations perpendicular to the jets, as these would produce unwanted transverse variations in pressure amplitude. In order to achieve this, large acoustic generators having a dimension, parallel to the linear array of nozzles, greater than the length of the array of nozzles have been used and complicated techniques, such as cutting a block of piezoelectric material into a comb like shape and attaching it to a membrane (as disclosed in U.S. Pat. No. 4,668,964) have been used in order to minimize the production of transverse waves. In other words it has been assumed that each nozzle in the array must be aligned immediately opposite either its own acoustic generator or its own part of an acoustic generator having a dimension parallel to the length of the array which is greater than the length of the array.

Surprisingly, the inventors have now found that this is not necessary and that, provided certain resonant conditions are satisfied, a single acoustic generator can satisfactorily stimulate the ink passing through an array of nozzles, or a part of an array of nozzles, which has a length considerably greater than the dimension of the acoustic generator parallel to the length of the array or part array.

SUMMARY OF THE INVENTION

In accordance with the present invention, a continuous ink jet printing device comprises a nozzle plate provided with a substantially linear array of nozzles and forming one wall of an ink cavity; and an acoustic generator in the form of an elongate body projecting, in a direction parallel to the direction in which the jets leave the nozzles, towards the nozzle plate in contact with ink in the cavity to transmit acoustic vibrations, in use, into the ink to cause uniform break up into droplets of ink jets leaving the nozzles, the body being shaped and tuned to vibrate substantially only in the longitudinal mode and at a resonant frequency which is within 10% of a frequency to excite natural resonant vibrations in the ink in the cavity between the end of the body and the nozzle plate, the width of the body being less than the length of the nozzle array, or of that part of the array associated with that body.

It is hypothesized that what occurs is that a standing planar wave, excited by the end of the elongate body is set up between the wall of the cavity opposite the nozzle plate and the nozzle plate, so that variable distances between the end of the body and the individual nozzles becomes unimportant. This leads to remarkable simplification of the stimulation of multi jet devices since in practice it is found that a linear array of nozzles five or even ten times greater in length than the width of the elongate body may be adequately stimulated. Only if the array is greater in length than this, may it be necessary to provide additional acoustic generator bodies alongside but spaced from one another.

The geometry of the cavity including the spacing of the end of the acoustic generator body from the nozzle plate will be dependent upon the speed of sound in the ink and the desired frequency of jet break up into droplets, and this will also dictate the resonant frequency of the acoustic generator body. As is known, it will be the length of the body which determines the resonant frequency of longitudinal vibrations in the body. The body may be arranged to provide substantially only longitudinal vibrations, by appropriate choice of the aspect ratio between its length and width, and in practice when the elongate body is a load rod consisting either of a rod of piezoelectric material, or a metallic rod with a piece of piezoelectric material at one end, the aspect ratio will normally be greater than two.

In a plane perpendicular to the nozzle plate and to the linear array of nozzles, the side walls of the ink cavity may converge towards the narrow nozzle array, thereby providing a focusing effect for the acoustic energy. The side walls may also be provided in part by the peripheral surface of an aperture in a spacer plate, which is replaceable by one of different thickness to tune the cavity and thereby allow for the use of different inks in which the velocity of sound is different, one from the other.

BRIEF DESCRIPTION OF THE DRAWINGS

The invention is illustrated diagrammatically in the accompany drawings, in which:

FIG. 1 is a vertical section through an ink jet printer;

DETAILED DESCRIPTION OF THE INVENTION

Figure 2:
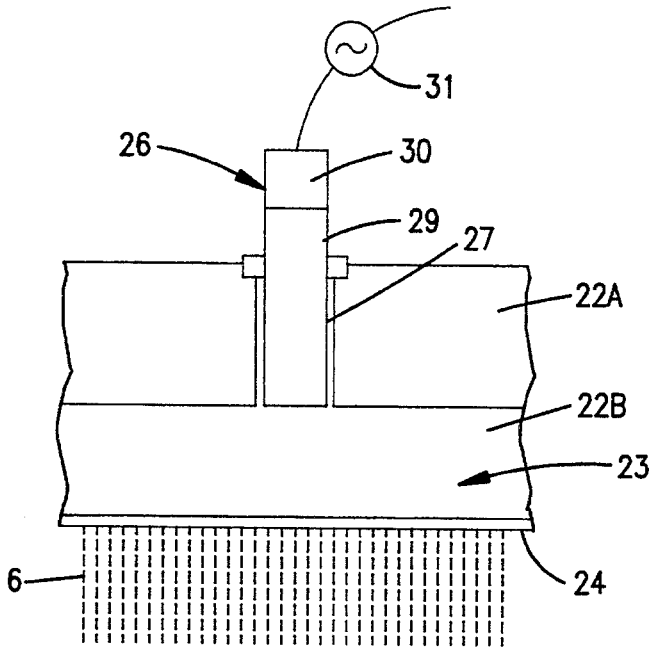
FIG. 2 is an elevation of an acoustic generator in the form of a single load rod.

FIG. 1 represents a conventional ink jet printer comprising an ink modulating device 5 which produces a coplanar array of downwardly directed streams 6 of ink droplets. The individual streams 6 pass through respective slots 7 in a charging electrode 8 so that individual droplets may be individually charged or left uncharged. The trains of droplets then pass down between an earth electrode 9 carried by a support block 10 and a deflection electrode 11 carried by a support block 12. The electrode 11 is continuously charged with the same positive or negative charge which is selectively applied to the droplets so that uncharged droplets continue in a straight path 6A whereas charged droplets are deflected along a path 6B and are caught in a gutter 13, from which they are drawn through an ink collection manifold 14 to a suction outlet 15. During start up and adjustment of the machine, the undeflected droplets passing along the paths 6A are caught in a secondary gutter 16 and withdrawn through a manifold 17 and suction outlet 18 in a support block 19. For printing, the block 18 and secondary gutter are moved to the left as indicated by the arrow 20 so that the undeflected droplets impinge on a moving web 21 to be printed.

The invention is concerned with the construction of the ink modulating device 5. This consists essentially of a rigid housing 22 formed by an upper plate 22A and a slotted lower plate 22B, which may, as shown in FIG. 4, be optionally divided into a lower most plate 22B' and an intermediate replaceable spacer plate 22B". The slot then defines an ink cavity 23. The lower end of the ink cavity, at the bottom of the slot in the plate 22B, is closed by a perforated metal foil 24, which forms the nozzle plate. The sides 25 of the slot may converge towards the nozzle plate as shown in FIG. 4.

The ink in the cavity is perturbed so that the jets of ink leaving the individual nozzles break up evenly into droplets by one or more load rods 26. Each of these extends through a respective oversized bore 27 in the upper plate 22A and is sealed to the bore by a sealing ring 28. The inner end of the load rod is substantially flush with the inner surface of the plate 22A. In fact each load rod 26 consists of a metal rod 29 with a piezoelectric material 30 at one end, the piezoelectric material being excited by appropriate means 31. It will be seen that the width of the load rod 26 is less than the length of a rod, and also less than the length of the array of modulated jets served by that load rod.

Figure 3:
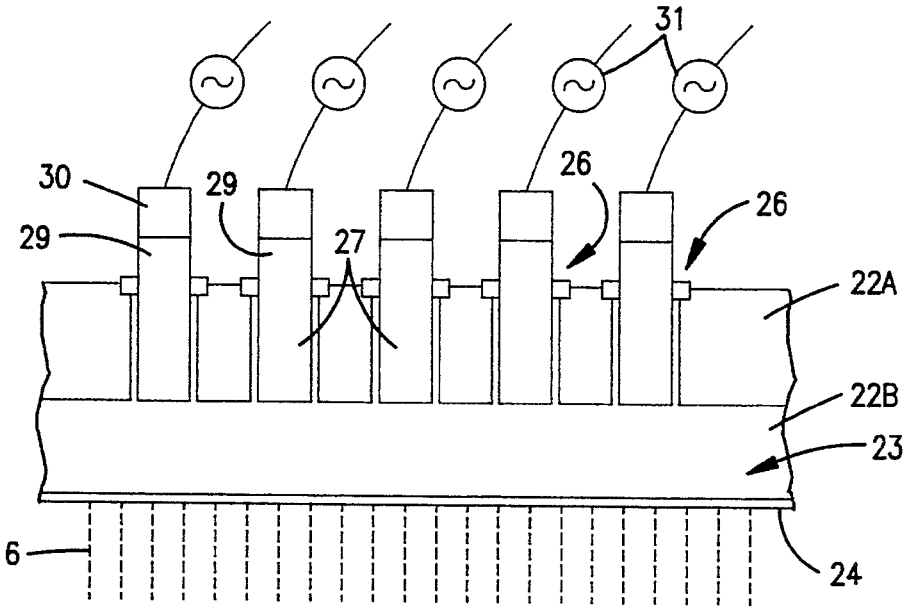
FIG. 3 corresponds to FIG. 2 but shows a modification in which a plurality of load rods are used; and, FIG. 4 is a cross section perpendicular to the planes of FIGS. 2 or 3.

FIG. 2 shows the case in which a single load rod is used and FIG. 3 shows the case in which a number of load rods are used, but in total, their widths are again considerably less than the lengths of the array of modulated jets.

As mentioned, the load rods are shown with their inner ends flush with the wall of the cavity opposite to the nozzle plate but in some cases it may be desirable for the end of the load rod to project into the ink cavity 23, or to be set back from the wall of the cavity opposite to the nozzle plate. To achieve acceptable modulation, the frequency, amplitude and phase of the individual actuators may be varied. Replacement of the spacer plate 22B" by one a different thickness maybe used to tune the cavity 23 and thereby allow for the use of different inks in which the velocity of sound is different, one from the other.

What is claimed is:

1. A continuous ink jet printing device comprising a nozzle plate (24) provided with a substantially linear array of nozzles and forming one wall of an ink cavity (23); and an acoustic generator in the form of an elongate body (26) projecting, in a direction parallel to the direction in which the jets leave the nozzles, towards the nozzle plate in contract with ink in the cavity to transmit acoustic vibrations, in use, into the ink to cause uniform break up into droplets of ink jets (6) leaving the nozzles, the body being shaped and tuned to vibrate substantially only in the longitudinal mode and at a resonant frequency which is within 10% of a frequency to excite natural resonant vibrations in the ink in the cavity between the end of the body and the nozzle plate, the width of the body being less than the length of the nozzle array, or of that part of the array associated with that body.

2. A device according to claim 1, in which the elongate body is a load rod consisting either of a rod of piezoelectric material, or a metallic rod (29) with a piece of piezoelectric material (30) at one end, the aspect ratio of which load rod being greater than two.

3. A device according to claim 1 or claim 2, in which, in a plane perpendicular to the nozzle plate (24) and to the linear array of nozzles, the side walls (25) of the ink cavity converge towards the nozzle array.

4. A device according to claim 1, in which the side walls of the ink cavity are provided in part by the peripheral surface of an aperture in a spacer plate, the spacer plate being mounted for selective removal such that it may be replaced by other spacer plates having a different thickness.

5. A device according to claim 2, in which the side walls of the ink cavity are provided in part by the peripheral surface of an aperture in a spacer plate, the spacer plate being mounted for selective removal such that it may be replaced by other spacer plates having a different thickness.

6. A device according to claim 3, in which the side walls of the ink cavity are provided in part by the peripheral surface of an aperture in a spacer plate, the spacer plate being mounted for selective removal such that it may be replaced by other spacer plates having a different thickness.

* * * * *